US005417640A

United States Patent [19]

Martin et al.

[11] Patent Number: 5,417,640

[45] Date of Patent: May 23, 1995

[54] METHOD FOR PREVENTING COHESION BETWEEN CARTON BLANKS

[75] Inventors: Roger L. Martin, San Jose; Ronald A. Moore, Hollister; Richard L. Humphries, Sunvale, all of Calif.

[73] Assignee: Jefferson Smurfit Corporation, Clatyton, Mo.

[21] Appl. No.: 89,568

[22] Filed: Jul. 12, 1993

[51] Int. Cl.[6] ..... B31B 1/25; B31B 1/94

[52] U.S. Cl. ..... 493/401; 493/402; 493/160; 493/161; 83/880

[58] Field of Search ..... 493/401, 402, 160, 161, 493/59, 60, 61, 62; 83/86, 89, 886, 887, 864, 879, 880, 883, 884

[56] References Cited

U.S. PATENT DOCUMENTS

| | | | |
|---|---|---|---|
| 2,589,022 | 3/1952 | Page, Jr. | 493/62 |
| 4,589,863 | 5/1986 | Hodges | 493/60 |
| 4,761,320 | 8/1988 | Coburn, Jr. | 428/167 |
| 4,931,031 | 6/1990 | Lisiecki | 493/60 |

*Primary Examiner*—Jack W. Lavinder
*Attorney, Agent, or Firm*—Richard W. Carpenter

[57] ABSTRACT

An improved method of preventing cohesion between plastic coated, paperboard, folding carton blanks after they come off a die cutter or cutting section of a press. The method comprises providing different scoring patterns for the carton blanks of alternate rows as the cartons are formed, which results in the creation of air spaces between adjacent cartons to prevent them from sticking to each other.

14 Claims, 2 Drawing Sheets

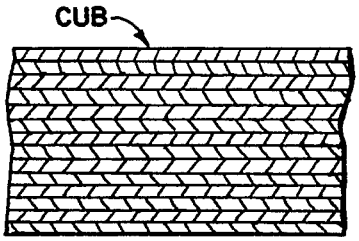
FIG. 1
(PRIOR ART)
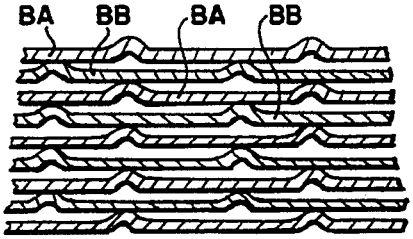
FIG. 2
FIG. 3
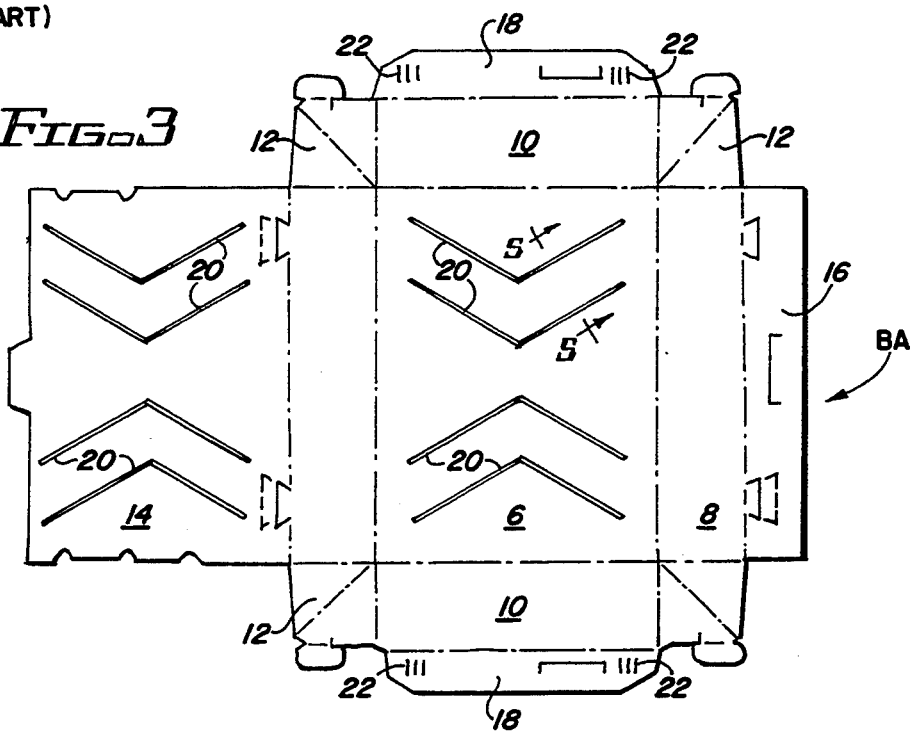
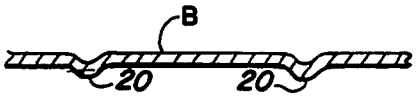
FIG. 5
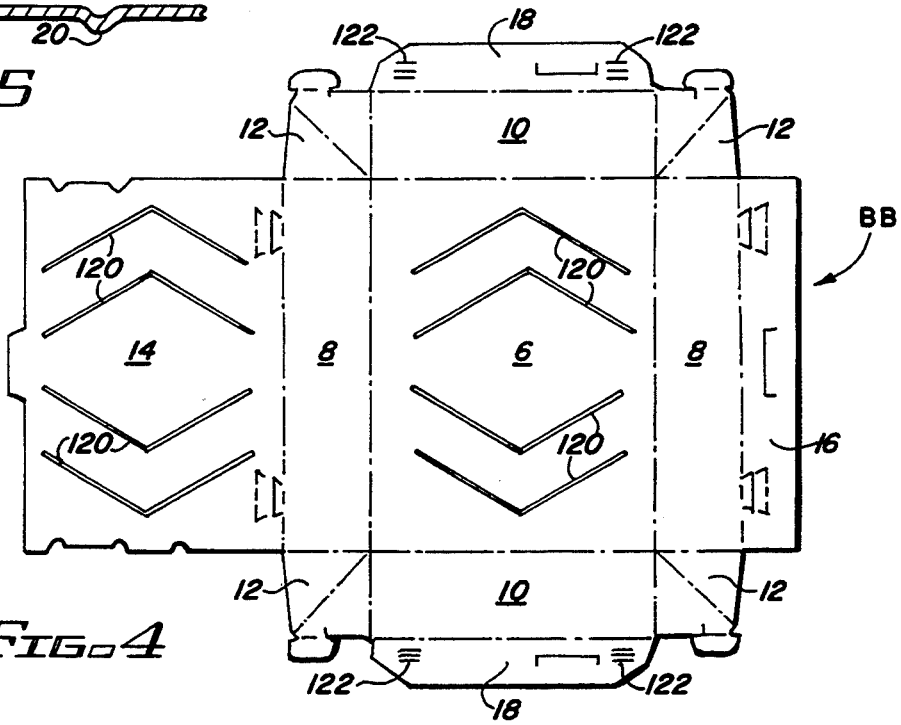
FIG. 4

METHOD FOR PREVENTING COHESION BETWEEN CARTON BLANKS

BACKGROUND OF THE INVENTION

1. Field of the Invention

This invention relates to the manufacturing of paperboard folding cartons, and, more particularly, to a method of preventing cohesion between plastic coated, paperboard, folding carton blanks when they stacked after coming off a web-fed die cutter or cutting section of a press.

2. Description of the Background Art

A background art search directed to the subject matter of this invention conducted in the United States Patent and Trademark Office disclosed the following United States Letters Patent:

U.S. Pat. Nos. 4,559,259, 4,575,298, 4,761,320, 5,178,377.

None of the patents found in the search discloses a method of preventing cohesion between plastic coated, paperboard, folding carton blanks when they come off a die cutter or cutting section of a press by providing different scoring patterns for the carton blanks of alternate rows as the cartons are formed.

SUMMARY OF THE INVENTION

It is a primary object of the invention to provide a method of preventing cohesion between plastic coated, paperboard, folding carton blanks when they come off a web-fed die cutter or cutting section of a press.

A more specific object of the invention is the provision of different scoring patterns for the carton blanks of alternate rows as the cartons are formed on a web-fed die cutter or cutting section of a press.

These and other objects of the invention will be apparent from an examination of the following description and drawings.

BRIEF DESCRIPTION OF THE DRAWINGS

FIG. 1 is a fragmentary, vertical, sectional view of a plurality of conventional, printed or unprinted, plastic coated, carton blanks of foldable paperboard stacked in a pile as they would be after coming off web-fed die cutter or cutting section of a press;

FIG. 2 is a fragmentary, vertical, sectional view of a plurality of printed or unprinted, plastic coated, carton blanks of foldable paperboard, scored in accordance with the teachings of the present invention, and stacked in a pile as they would be after coming off a web-fed die cutter or die cutting section of a press;

FIGS. 3 and 4 are top plan views of carbon blanks, embodying features of the present invention, as they would be formed in adjacent rows from material of a paperboard web on the die cutter or die cutting section of a web-fed press;

FIG. 5 is a fragmentary sectional view taken on line 5—5 of FIG. 3.

Figure 6:
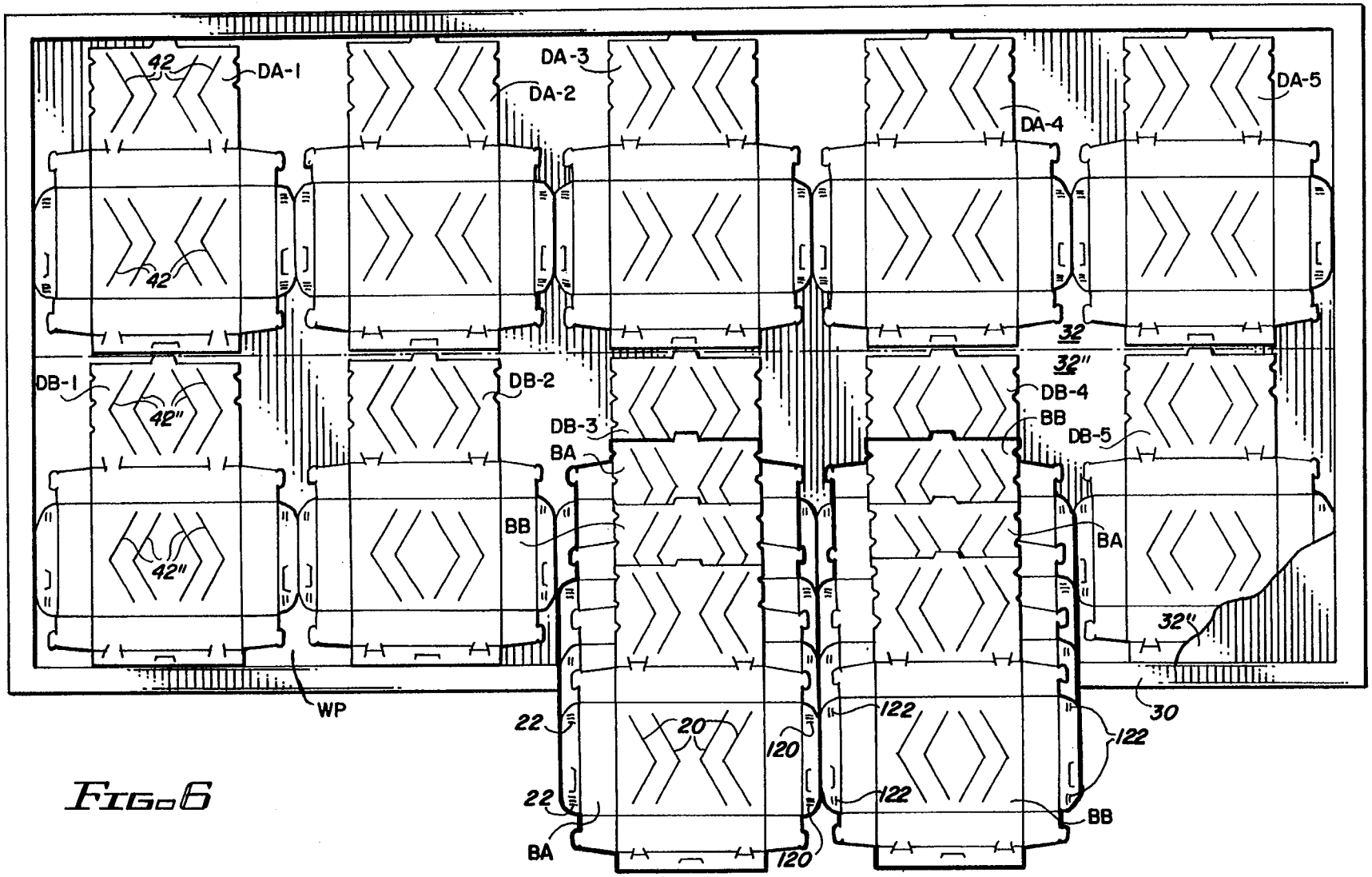
FIG. 6 is a fragmentary top plan view illustrating the layout of cartons in alternate rows extending across a web of paperboard on a die cutter or die cutting section of a press.

It will be understood that, for purposes of clarity, certain elements may have been omitted from certain views where they are believed to be illustrated to better advantage in other views.

DESCRIPTION OF THE PREFERRED EMBODIMENT

When plastic coated, paperboard, folding carton blanks come off a die cutter or the die cutting section of a web-fed press, they are automatically stacked vertically one atop the other. Unlike uncoated blanks, blanks coated on both sides with a plastic film tend to stick to each other by cohesion and/or because of a partial vacuum between adjacent blanks.

In FIG. 1 there is illustrated a stack of conventional, plastic coated, unscored, paperboard, folding carton blanks identified as CUB. It is apparent that there is no space between adjacent blanks. In order to overcome the problem of blanks sticking to each other, it has been a common practice to apply an offset spray powder between adjacent blanks.

This requires costly application equipment and is a relatively messy operation in the carton manufacturer's plant, as well as in the plant of the manufacturer's customer.

The present invention provides a simple, inexpensive way to overcome the sticking problem. This is accomplished by providing special stacking scores in the blanks, wherein the patterns of these special stacking scores are different for alternate blanks as they come off a press or die cutter and are stacked one atop the other, to create air pockets or spaces between adjacent blanks.

In FIG. 2 there is illustrated a stack of carton blanks embodying features of the invention. The stack of invention blanks comprises blanks BA, of the type illustrated in FIG. 3, and blanks BB, of the type illustrated in FIG. 4. The blanks BA and BB are alternately arranged on a stack as illustrated in FIG. 2, so that no blank is adjacent an identical blank.

Thus, it is apparent that spaces are provided between adjacent blanks, by a method hereinafter described, so that adjacent blanks will not cohere or stick to each other.

As best seen in FIGS. 3 and 4, while blanks BA and BB are similar to each other in that all of the working scores and cut lines are the same, there are provided additional special scores in each blank in accordance with the teachings of the present invention. The patterns of these special scores of alternately formed blanks are different from each other.

Each of the blanks comprises: a main or bottom wall panel 6; a pair of front and rear side wall panels 8, foldably joined to front and rear side edges of bottom wall panel 6; a pair of end wall panels 10, foldably joined to opposed end edges of bottom wall panel 6; gusset members 12 at the corners of the blank, foldably interconnecting each side wall panel to a related end wall panel; a top wall panel or cover 14, foldably joined to a rear side wall panel; a front dust flap, foldably jointed to a front side wall panel; and a pair of end dust flaps, foldably joined to related end wall panels. The various panels of each blank are foldably joined to each other along fold lines by conventional working scores.

These conventional working score, as well as necessary cut lines in the blanks are not identified by numerals or described in detail, as they are not part of the invention. In fact the cartons shown in the drawings are for illustrative purposes only, because the invention can be used with carton blanks of various shapes and sizes.

Still referring to FIGS. 3 and 4, it will be seen that blank BA is provided with two sets of special stacking scores. Panels 6 and 14 are provided with a first set 20 of special stacking scores that are chevron-like or V-shaped, and panels 18 are provided with a second set 22 of special stacking scores that include a plurality of spaced parallel lines.

In the case of blank BB, the special V-shaped scores 120 in panels 6 and 12 are similar to scores 20 in blank BA, except that they run in opposite directions from the comparable scores of blank BA. Likewise special scores 122 in panels 18 are similar to special scores 22 of blanks BA, except that they run in opposite directions from those of blank BA. Thus, when a blank BA is placed above or below a blank BB, as seen in FIG. 2, spaces are provided between adjacent blanks to prevent them from nesting snugly and sticking to each other.

The scores can be formed by standard scoring equipment and can be formed on either side of the blanks, so as to be either embossed or debossed.

The method by which these alternate scoring patters is best understood by reference to FIG. 6 of the drawings. As the web Wp of plastic coated paperboard moves along the die cutter or the cutting section of a press, it travels over a chase or frame 30 containing a pair of adjacent first and second rows of dies 32 and 32″. Each die row includes a plurality of die positions or stations. The dies or die positions of row 32 are indicated at DA1, DA2, DA3, DA4, and DA5; whereas the dies or die positions of row 32″ are indicated at DB1, DB2, DB3, DB4, and DB5.

The chase and dies may be of any conventional design commonly used in the production of paperboard folding cartons. As seen in FIG. 6, chase 30 is a rectangular frame adapted to hold a plurality of dies which are generally placed in the chase by a diemaker or pressman. Each die usually consists of a flat block of wood or plastic within which is inserted a plurality of metal strips, such as 42 and 42″, which are known as scoring rules or cutting bars.

If necessary, dies can be wedged in position in the chase by the use of a plurality of conventional wedges (not shown). After the chase and dies have been assembled, the chase can be locked in the bed of a press or die-cutter in a conventional manner.

The important requirement of the present invention is that all of the die positions of each row have the same scoring pattern, and that all of the die positions of the adjacent row have a different scoring pattern, so that, as the finished blanks BA and BB come off the die cutter or press and are automatically stacked one atop the other as illustrated at the lower part of FIG. 6, no blank of any stack will have exactly the same scoring pattern as that of the adjacent blank located above or below it.

In the arrangement of the present invention, illustrated in FIG. 6, the dies of row 32 form the scoring pattern of carton blank BA, shown in FIG. 3; whereas, the dies of row 32″ form the scoring pattern of carton blank BB, shown in FIG. 4.

Thus, it should be appreciated that the invention provides a relatively simple and economical method for preventing plastic coated cartons from sticking to each other when they are stacked vertically. Also, the method can be employed with conventional die cutting equipment, and does not require the use of costly powder application equipment.

Perhaps the most important advantage of the invention is that it eliminates the mess, in both the carton manufacturer's plant and the carton packer's plant, that results from the application of offset powder.

What is claimed is:

1. A method for preventing cohesion between adjacent, plastic coated, paperboard, folding carton blanks when the blanks are stacked vertically, one atop the other, after they come off a unit of die cutting equipment, said method comprising:

(a) providing a die holding chase for said die cutting unit;

(b) providing, in said chase, a pair of adjacent first and second sets of dies each containing a plurality of dies for cutting and scoring paperboard to form carton blanks;

(c) advancing the paperboard through the first and second sets of dies to continuously form a plurality of carton blanks having special stacking scores wherein the first set of dies comprise scoring means for forming first special stacking scores on a first carton blank and the second set of dies comprise scoring means for forming on the next carton blank a second set of special stacking scores different from the first set of special stacking scores, whereby, as said carton blanks come off said die cutting unit and are stacked vertically, one atop the other, each one of said carton blanks will have a different stacking score pattern than that of the adjacent carton blanks, located immediately above and immediately below said one carton blank in said stack, to create air spaces between adjacent carton blanks and thereby prevent each one of said carton blanks in said stack from cohering to an adjacent carton blank in the stack.

2. A method according to claim 1, wherein each of said score patterns formed in said carton blanks includes special scores that are in addition to and unrelated to any working scores that may be necessary for said blanks.

3. A method according to claim 2, wherein said special scores are formed in central areas of said carton blanks.

4. A method according to claim 2, wherein said special scores are formed in marginal areas of said carton blanks.

5. A method for preventing cohesion between adjacent, paperboard, folding carton blanks when the blanks are stacked vertically, one atop the other, after they come off a unit of die cutting equipment, said method comprising:

(a) providing a die holding chase for said die cutting unit;

(b) providing, in said chase, at least two adjacent sets of dies each containing a plurality of dies for cutting and scoring paperboard to form carton blanks;

(c) advancing the paperboard through the two adjacent sets of dies to continuously form a plurality of carton blanks having special stacking scores wherein the one of the two adjacent sets of dies comprise scoring means for forming first special stacking scores on a first carton blanks and the other of the two adjacent sets of dies comprises scoring means for forming on the next carton blank a second set of special stacking scores different from the first set of special stacking scores, whereby, as carton blanks come off said die cutting unit and are stacked vertically, one atop the other, each one of said carton blanks will have a different stacking score pattern than that of the adjacent carton blanks, located immediately above and immediately below said one carton blank in said stack, to create air spaces between adjacent blanks and thereby prevent each one of said carton blanks in said stack from cohering to an adjacent carton blank in the stack.

6. A method according to claim 5, wherein each of said score patterns formed in said carton blanks includes special scores that are in addition to and unrelated to any working scores that may be necessary for said blanks.

7. A method according to claim 6, wherein said special scores are formed in central areas of said carton blanks.

8. A method according to claim 6, wherein said special scores are formed in marginal areas of said carton blanks.

9. A method for preventing cohesion between adjacent, paperboard, folding carton blanks when the blanks are stacked vertically, one atop the other, after they come off a unit of die cutting equipment, said method comprising:

(a) providing die means including at least two adjacent sets of dies each containing a plurality of dies for cutting and scoring paperboard to form carton blanks;

(b) advancing the paperboard through the two adjacent sets of dies to continuously form a plurality of carton blanks having special stacking scores wherein the one of the two adjacent sets of dies comprise scoring means for forming first special stacking scores on a first carton blank and the other of the two adjacent sets of dies comprise scoring means for forming on the next carton blank a second set of special stacking scores different from the first set of special stacking scores, whereby, as carton blanks come off said die cutting unit and are stacked vertically, one atop the other, each one of said carton blanks will have a different stacking score pattern than that of the adjacent carton blanks, located immediately above and immediately below said one carton blank in said stack, to create air spaces between adjacent carton blanks and thereby prevent each one of said carton blanks in said stack from cohering to an adjacent carton blank in the stack.

10. A method according to claim 9, wherein each of said score patterns formed in said carton blanks includes special scores that are in addition to and unrelated to any working scores that may be necessary for said blanks.

11. A method according to claim 10, wherein said special scores are formed in central areas of said carton blanks.

12. A method according to claim 10, wherein said special scores are formed in marginal areas of said carton blanks.

13. A method according to claim 9, wherein said special scores are debossed.

14. A method according to claim 9, wherein said special scores are embossed.

* * * * *